US006582026B2

(12) United States Patent
Bertrand

(10) Patent No.: US 6,582,026 B2
(45) Date of Patent: Jun. 24, 2003

(54) MACHINE FOR CUTTING PAVEMENT

(76) Inventor: René Bertrand, 781 rue Fernet, St-Jean-sur-Richelieu, Québec (CA), J3B 6Y8

( * ) Notice: Subject to any disclaimer, the term of this patent is extended or adjusted under 35 U.S.C. 154(b) by 82 days.

(21) Appl. No.: 09/976,102

(22) Filed: Oct. 15, 2001

(65) Prior Publication Data

US 2002/0024249 A1 Feb. 28, 2002

(51) Int. Cl.[7] ..... B28D 1/04

(52) U.S. Cl. ..... 299/39.3; 299/75; 299/81.1; 125/13.03

(58) Field of Search ..... 83/485, 486, 486.1, 83/487; 248/649, 354.1, 188.2, 188.5, 188.6; 299/39.3, 72, 75, 36.1, 81.1; 125/12.14, 13.01, 13.03

(56) References Cited

U.S. PATENT DOCUMENTS 4,572,303 A * 2/1986 Marechal ..... 299/75
4,584,918 A * 4/1986 Stubbe et al. ..... 83/486.1
4,754,713 A * 7/1988 Chatenay epouse Compagnone ..... 248/188.2
4,792,190 A * 12/1988 Bertrand ..... 299/41.1
5,135,287 A * 8/1992 Karnes ..... 299/39.3
5,676,125 A * 10/1997 Kelly et al. ..... 299/75
6,158,817 A * 12/2000 Bertrand ..... 299/39.3

* cited by examiner

*Primary Examiner*—Heather Shackelford
*Assistant Examiner*—John Kreck
(74) *Attorney, Agent, or Firm*—Robic

(57) ABSTRACT

A machine for cutting pavement, street curbs, bridge components, or sidewalks. The cutting apparatus is mounted on a truck body for transport and can be extended from the truck and supported directly on the ground for cutting. The cutting apparatus includes a rotary saw mounted on rails for mobility in all directions at different angles. The rails are supported on the ground by extendable supports, and the supports can be adjusted to allow the saw to b used on uneven ground.

25 Claims, 17 Drawing Sheets

MACHINE FOR CUTTING PAVEMENT

FIELD OF THE INVENTION

The present invention relates to a machine for cutting pavement such as a sidewalk, a side edge of a bridge, a curb of a highway or the like. This machine is an improvement of the machine disclosed in Canadian patent no. 1,253,420 granted on May 2, 1989, and its U.S. counterpart U.S. Pat. No. 4,792,190 granted on Dec. 20, 1988.

BACKGROUND

The machine disclosed and claimed in the above Canadian and US patents is designed for cutting curbstones, sidewalks or the like. The machine comprises a cutting apparatus having two booms and a main rail along which a saw is moving. The main rail is mounted perpendicularly to the booms which are able to pivot downwardly and upwardly in unison. Each boom has a ground-contacting leg at its end for supporting the weight of the cutting apparatus and stabilizing it. When the cutting apparatus is put down on a surface that is not flat, adjustment of the height of the legs has to be performed simultaneously by at least two workers. Coordination work is thus necessary to install the cutting apparatus of the machine when the surface on which the apparatus is installed, is not flat. In such a case, failure to adjust the height of the legs may cause torsion at the attachment of the main rail on the booms and therefor possibly generating failures at the attachment.

Moreover, the machine disclosed in the above patent is not adapted to cut a surface that follows an inclined line on a long distance.

There is a need for a machine that overcomes these drawbacks.

SUMMARY OF THE INVENTION

The object of the present invention is to provide a machine for cutting pavement, which comprises a cutting apparatus that can be easily installed on a surface that is not flat.

More particularly, the object of the present invention is to provide a machine including a powered truck-like vehicle having a support base and an apparatus mounted on the base for cutting pavement. The apparatus comprises:

- two spaced-apart cylindrical booms, each boom having one end pivotally mounted on the base and an opposite end;
- tilting means mounted on the base for tilting each boom about its one end in a vertical plane;
- a supporting bar mounted on the opposite ends of the cylindrical booms so as to be free to rotate about the cylindrical booms within a plane perpendicular to the cylindrical booms;
- an extendible, ground-contacting leg at each end of the supporting bar for stabilizing the apparatus;
- a rail-structure-holding head slidably mounted on each cylindrical boom so as to slide along the cylindrical boom and to be free to rotate about the cylindrical boom within a plane perpendicular to the cylindrical boom;
- sliding means for sliding each head separately along the corresponding boom;
- an elongated main rail;
- main rail mounting means for mounting the main rail on the heads and for rotating the main rail about a longitudinal axis parallel to the elongated main rail;

- a saw carrier mounted on the main rail;
- displacing means for moving the saw carrier along the main rail in a first direction parallel to the longitudinal axis;
- a motorized saw mounted on the saw carrier; and
- moving means for moving the saw on the saw carrier in a second direction perpendicular to the longitudinal axis As it can be appreciated, the machine according to the present invention has rail-structure-holding heads and a supporting bar that are mounted on cylindrical booms so as to be free to rotate about each of the cylindrical booms within a plane perpendicular to each of the cylindrical booms. Such free rotation of the supporting bar and the rail-structure-holding heads allows the apparatus to be put down on an uneven surface without necessitating simultaneous adjustment of the legs of the supporting bar. This free rotation also allows the main rail to adopt an inclined position along which the saw may be moved to cut at an angle if desired.

According to a preferred embodiment of the invention, each of the rail-structure-holding heads has separate connecting means for allowing connection of the main rail mounting means at different distances away from the vehicle. This preferred feature allows either extension of the apparatus in order to saw beyond the legs mounted on the supporting bar, or compact settlement of the apparatus in order to occupy one road line in addition to the road line occupied by the vehicle.

According to another preferred embodiment of the invention, the main rail mounting means comprises:

- a helical rotary actuator attached to one of the rail-structure-holding heads, the helical rotary actuator having a shaft extending along the longitudinal axis about which the main rail rotates; and
- at least one member attached to the shaft and to the main rail for driving the main rail into rotation about the longitudinal axis.

This preferred feature of the invention allows a wide rotation of the main rail about the longitudinal axis, that may reach 220°.

According to still another preferred embodiment of the invention, the saw carrier comprises at least one pole extending along the second direction perpendicular to the longitudinal axis; the saw is slidably mounted on said at least one pole; and the moving means for moving the saw on the saw carrier in the second direction comprise:

- at least one motorized endless screw mounted on the saw carrier in parallel to the at least one pole and operatively engaging the saw,
- a flexible dust cover covering the endless screw, and
- a rod mounted on the saw carrier in parallel relationship above the endless screw, the rod preventing the dust cover from contacting the endless screw.

The dust cover according to this preferred embodiment of the invention prevents mud or the like to clog the endless screw, and the rod prevents the flexible dust cover from contacting the endless screw and getting worn out by the back and forth movement of the saw on the saw carrier along the second direction. Replacement of the dust cover is time consuming and therefore, involves expenses.

According to a further embodiment of the invention, the saw has a rotary blade, a motorized propeller shaft for propelling the rotary blade, a holding structure surrounding the propeller shaft, and a cooling system. The cooling system comprises:

a ring-shaped recess made into the holding structure, the ring-shaped recess surrounding the propeller shaft and being in contact with it;

a water inlet in the ring-shaped recess;

a water outlet in the ring-shaped recess, the water outlet having an exhaust directed towards a top surface of the rotary blade;

an L-shaped water duct made into the propeller shaft, the L-shaped water duct opening into the ring-shaped recess and exiting at a bottom of the propeller shaft so as to bring water to a bottom surface of the rotary blade.

The cooling system according this preferred feature of the invention allows water to reach both surfaces of the rotary blade.

According to still a further embodiment of the invention, the saw has a rotary blade and an articulated guard substantially covering half of the rotary blade, said guard being pivotally mounted on the saw so as to uncover any portion of the periphery of the rotary blade. In the prior art, the guard can only be mounted in two opposite positions on the rotary blade. This preferred embodiment of the invention allows the articulated guard to be secured at any position around the rotary blade and to free any desired side of the rotary blade for better convenience.

According to another further embodiment of the invention, the apparatus also comprises locking means for locking the saw carrier when the powered truck-like vehicle is moving so as to prevent any sliding motion of the saw carrier along the main rail. This locking means has the advantage of securing the saw carrier along the main rail and preventing its displacement when the vehicle is moving.

The invention, its operation and its advantage will be better understood upon reading the following non restrictive description of a preferred embodiment thereof, made with references to the accompanying drawings.

NUMERAL REFERENCES OF THE ELEMENTS SHOWN IN THE DRAWINGS

Figure 1:
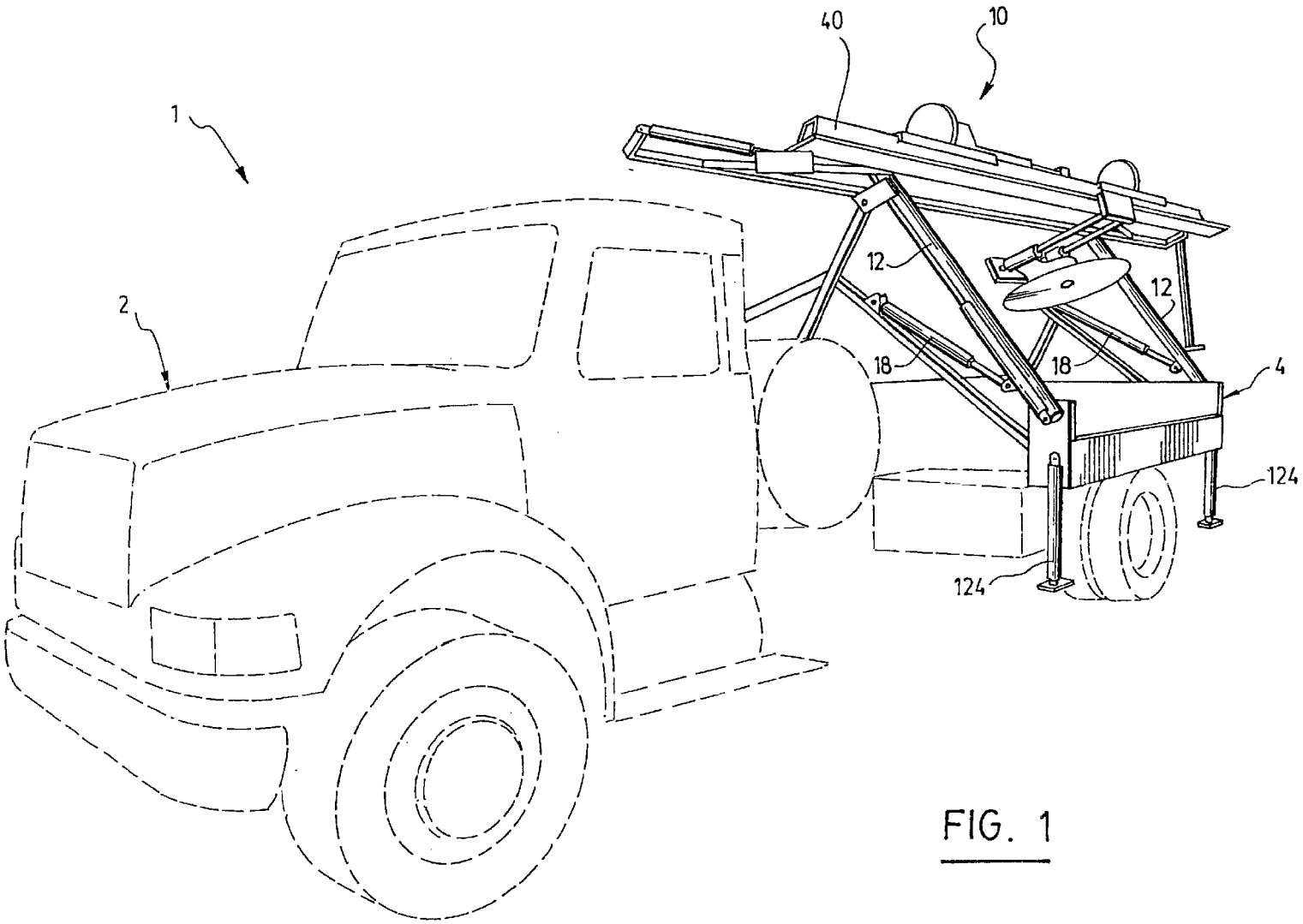
FIG. 1 is a perspective view of a truck on which a machine according to the invention is mounted.

1 machine
2 powered truck-like vehicle
4 support base
10 apparatus
12 cylindrical boom
14 one end of the cylindrical boom
16 opposite end of the cylindrical boom
18 powered jack of the tilting means
20 one end of the powered jack of the tilting means
20' another end of the powered jack of the tilting means
22 supporting bar
24 ring of the supporting bar
26 metal strip
28 extendible, ground-contacting leg of the supporting bar
30 foot of the leg of the supporting bar
32 rail-structure-holding head
34 pad of the surrounding means of the rail-structure-holding head
36 powered jack of the sliding means for sliding the head
38 one end of the powered jack of the sliding means
38' another end of the powered jack of the sliding means
40 main rail
42 plate of the rail-structure-holding head
44 hole made in the plate of the rail-structure-holding head
46 pivot pin of the main rail mounting means
48 one plate of the main rail mounting means
48' another plate of the main rail mounting means
50 helical rotary actuator
52 member of the main rail mounting means
54 saw carrier
56 saw

58 plate of the means for slidingly mounting the saw carrier
60 wheel of the means for slidingly mounting the saw carrier
62 border of the main rail
64 toothed rack of the displacing means for moving the saw carrier
66 powered pinion wheel of the displacing means of the saw carrier
68 pole of the saw carrier
70 endless screw of the moving means for moving the saw
71 pinion of the endless screw
72 gear engaging the pinion of the endless screw
73 powered pinion propelling the gear
74 flexible dust cover
76 rod underneath the flexible dust cover
78 powered jack of the saw carrier
80 rotary blade of the saw
82 motorized propeller shaft of the saw
84 holding structure of the saw
86 ring-shaped recess of the cooling system
88 water inlet of the cooling system
90 water outlet of the cooling system
92 exhaust of the water outlet of the cooling system
94 top surface of the rotary blade
96 L-shaped water duct of the cooling system
98 bottom of the propeller shaft of the saw
100 bottom surface of the rotary blade
102 O-ring of the cooling system
104 second O-ring of the cooling system
106 bearings of the propeller shaft
107 water drain of the cooling system
108 articulated guard of the saw
110 powered jack for moving the main rail in the first direction
112 end of the powered jack for moving the main rail in the first direction
114 distal portion of the main rail
116 central portion of the main rail
118 powered jack for upwardly pivoting the distal portion of the main rail
120 joining pin
122 joining pin receiver
124 disk of the rotary actuator
126 periphery of the disk of the rotary actuator
128 pad of the braking system
130 plate on which the pad of the braking system is fixed
132 powered jack for pressing the pad of the braking system
134 slick plate of the braking system
136 supporting member of the slick plate of the braking system

DESCRIPTION OF A PREFERRED EMBODIMENT

The machine (1) according to the preferred embodiment of the invention as shown in FIG. 1, includes a powered truck-like vehicle (2) having a support base (4) and an apparatus (10) mounted on the base (4) for cutting pavement such as a sidewalk, a side edge of a bridge, a curb of a highway or the like.

Figure 4:
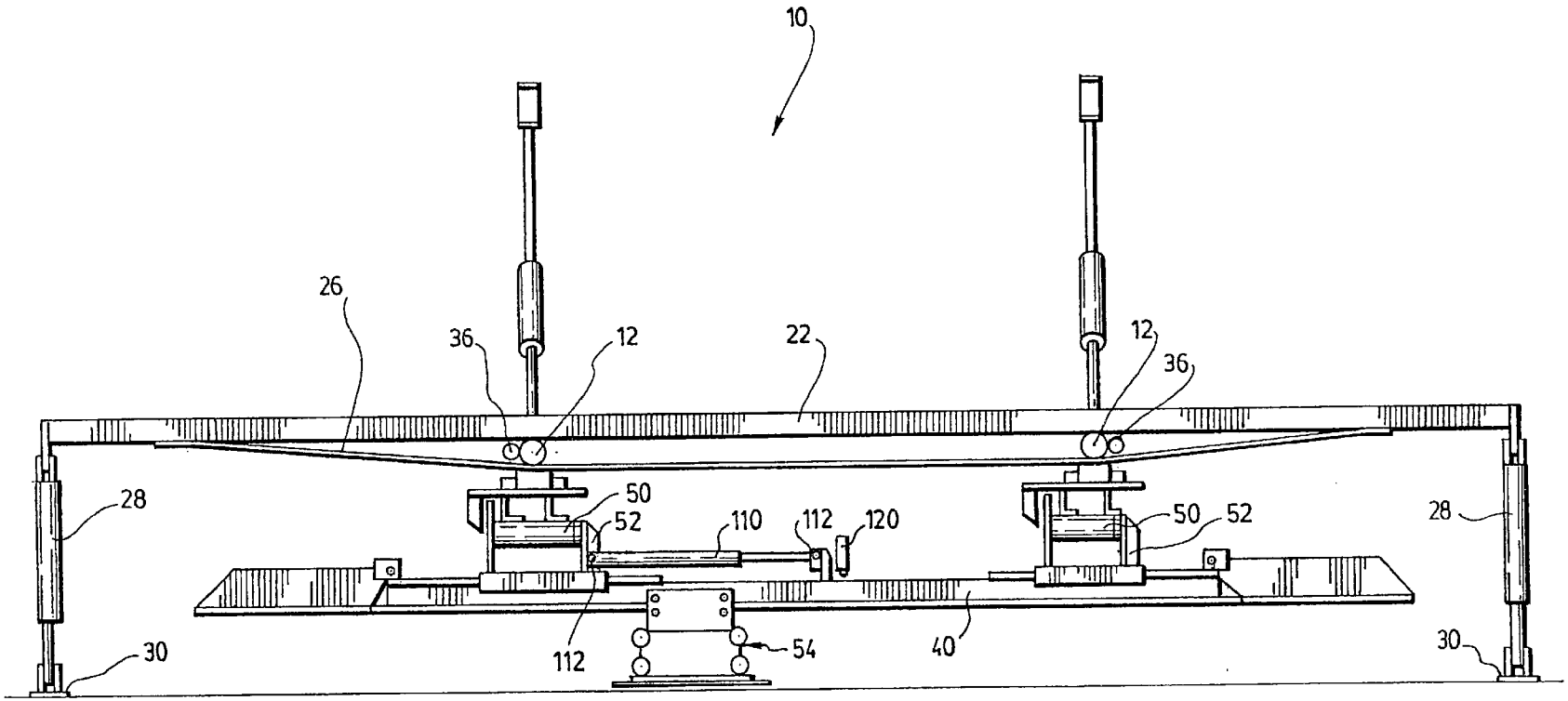
FIG. 4 is a front view of the machine according to the invention.
Figure 5:
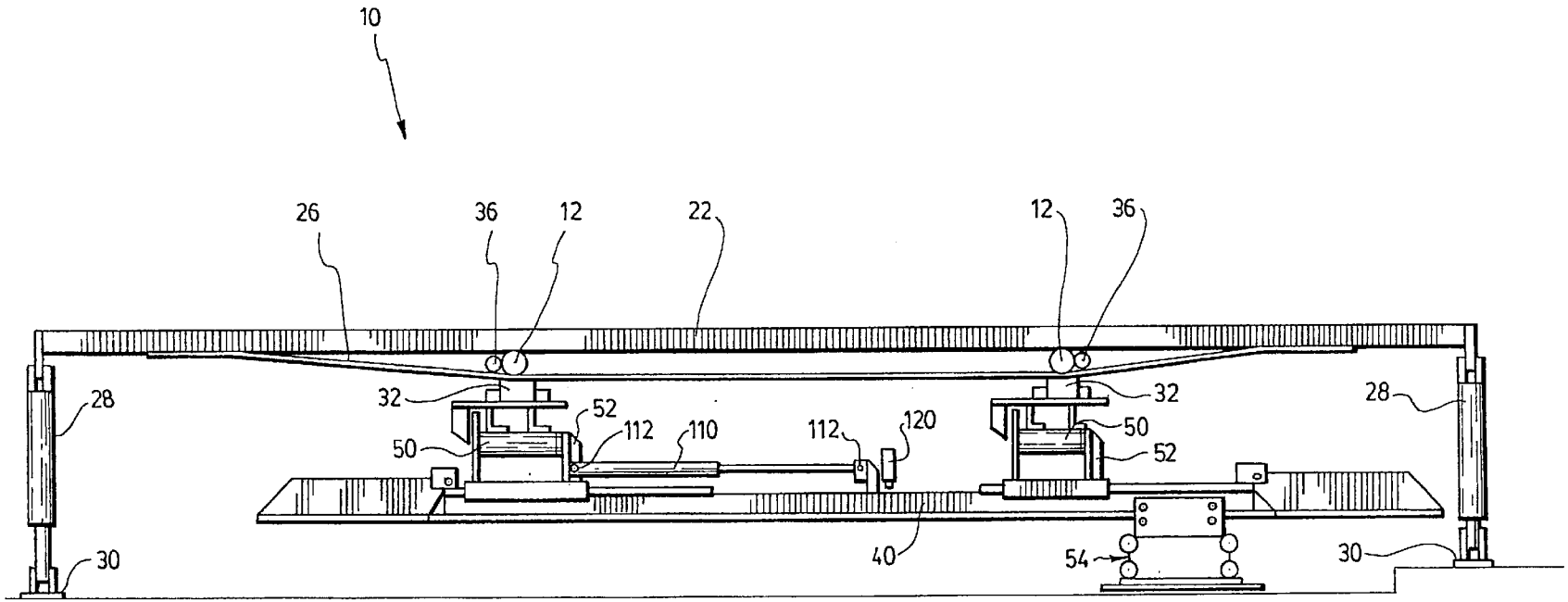
FIG. 5 is a front view similar to the one of FIG. 4, showing the main rail of the apparatus shifted to the right hand side with respect to the rail-structure-holding heads, and one of its legs leaning on an elevated portion of the pavement.
Figure 6:
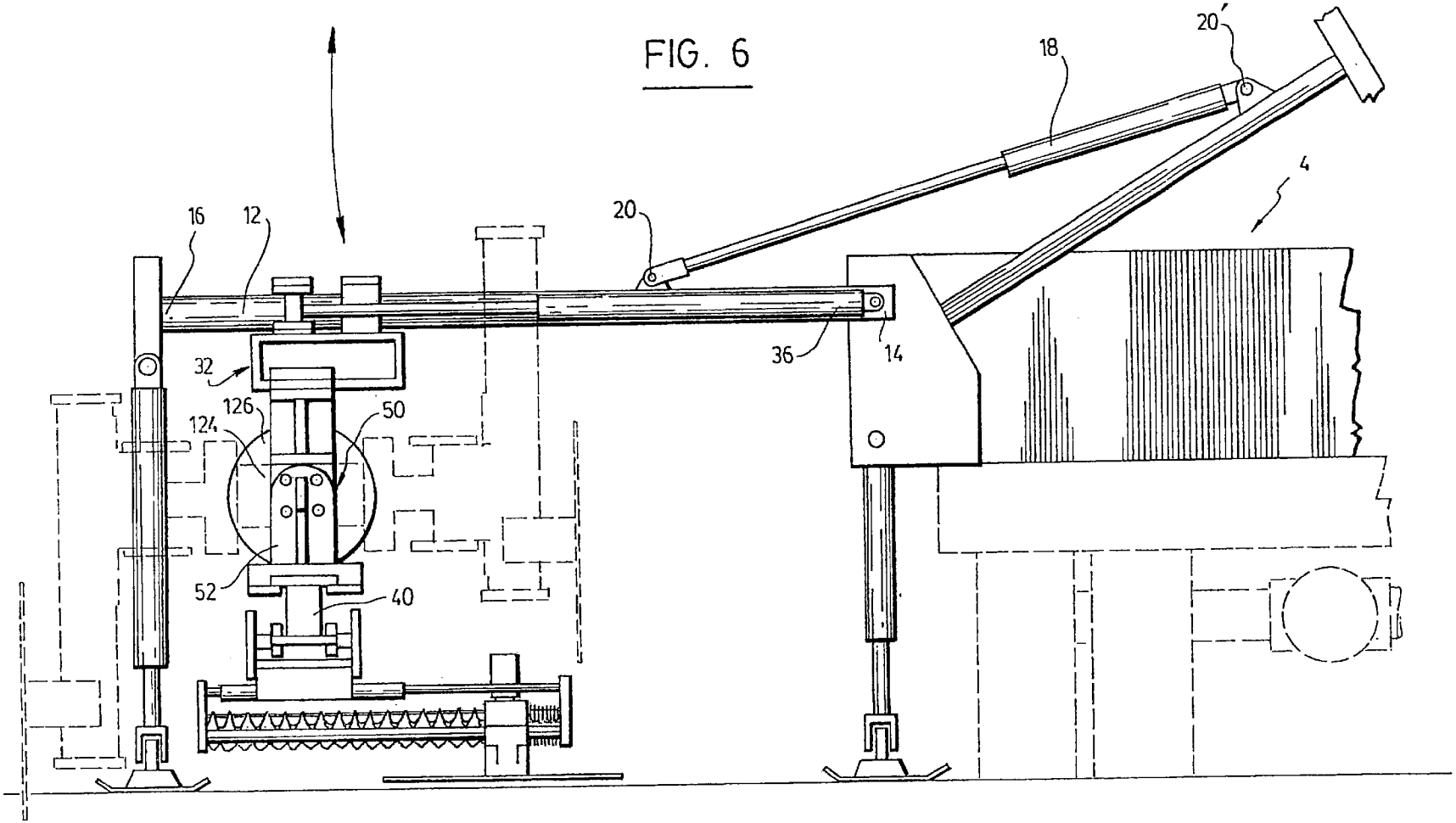
FIG. 6 is a side elevational view of the machine according to the invention showing the main rail in three different positions of rotation; and the saw in two different positions with respect to the saw carrier.

As shown in FIGS. 1, 4, 5 and 6, the apparatus (10) comprises two spaced-apart cylindrical booms (12). Each boom (12) has one end (14) pivotally mounted on the base (4) and an opposite end (16). The apparatus further comprises tilting means mounted on base (4) for tilting each boom (12) about its one end (14) in a vertical plane. Each boom (12) may pivot up and down under the action of the tilting means, as indicated by the double arrow in FIG. 6. As better illustrated in FIG. 1, the tilting means comprise two powered jacks (18). Referring more particularly to FIG. 6, each powered jack (18) has ends (20 and 20') respectively connected to the corresponding boom (12) and to the support base (4) so that contraction and extension of each powered jack (18) pivot up and down the corresponding boom (12).

Figure 7:
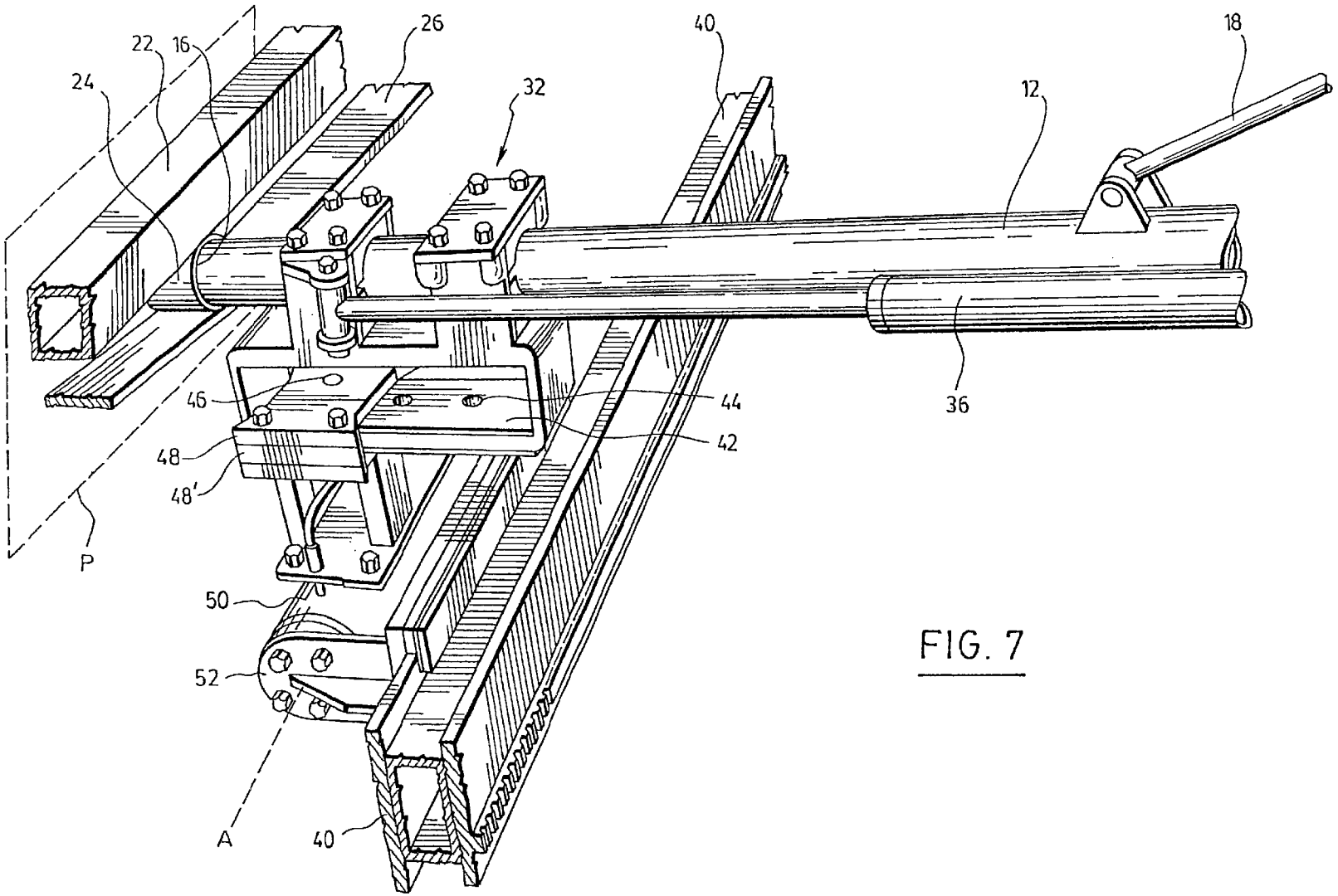
FIG. 7 is a partial perspective view of the machine according to the invention, showing a portion of the supporting bar and one of the rail-structure-holding heads mounted on one of the cylindrical booms.

As shown in FIGS. 4, 5 and 7, the apparatus (10) also comprises a supporting bar (22) mounted on the opposite ends (16) of the cylindrical booms (12) so as to be free to rotate about the cylindrical booms (12) within a plane P perpendicular to the cylindrical booms (12). In the preferred illustrated embodiment of the invention, the supporting bar has a surrounding means for surrounding each opposite end (16) of the cylindrical booms (12) and allowing said free rotation of the supporting bar (22) about the cylindrical booms (12). As better illustrated in FIG. 7, each surrounding means preferably comprises a ring (24) solidly attached under the supporting bar (22). To solidify the attachment of the rings under the bar, a metal strip (26) is welded under the rings (24) and the bar (22).

As shown in FIGS. 4 and 5, the apparatus (10) further comprises an extendible, ground-contacting leg (28) at each end of the supporting bar (22) for stabilizing the apparatus (10). Each leg (28) preferably consists of a powered jack ending with a flat foot (30). Advantageously, each leg (28) is pivotally mounted on the end of the supporting bar (22).

Figure 2:
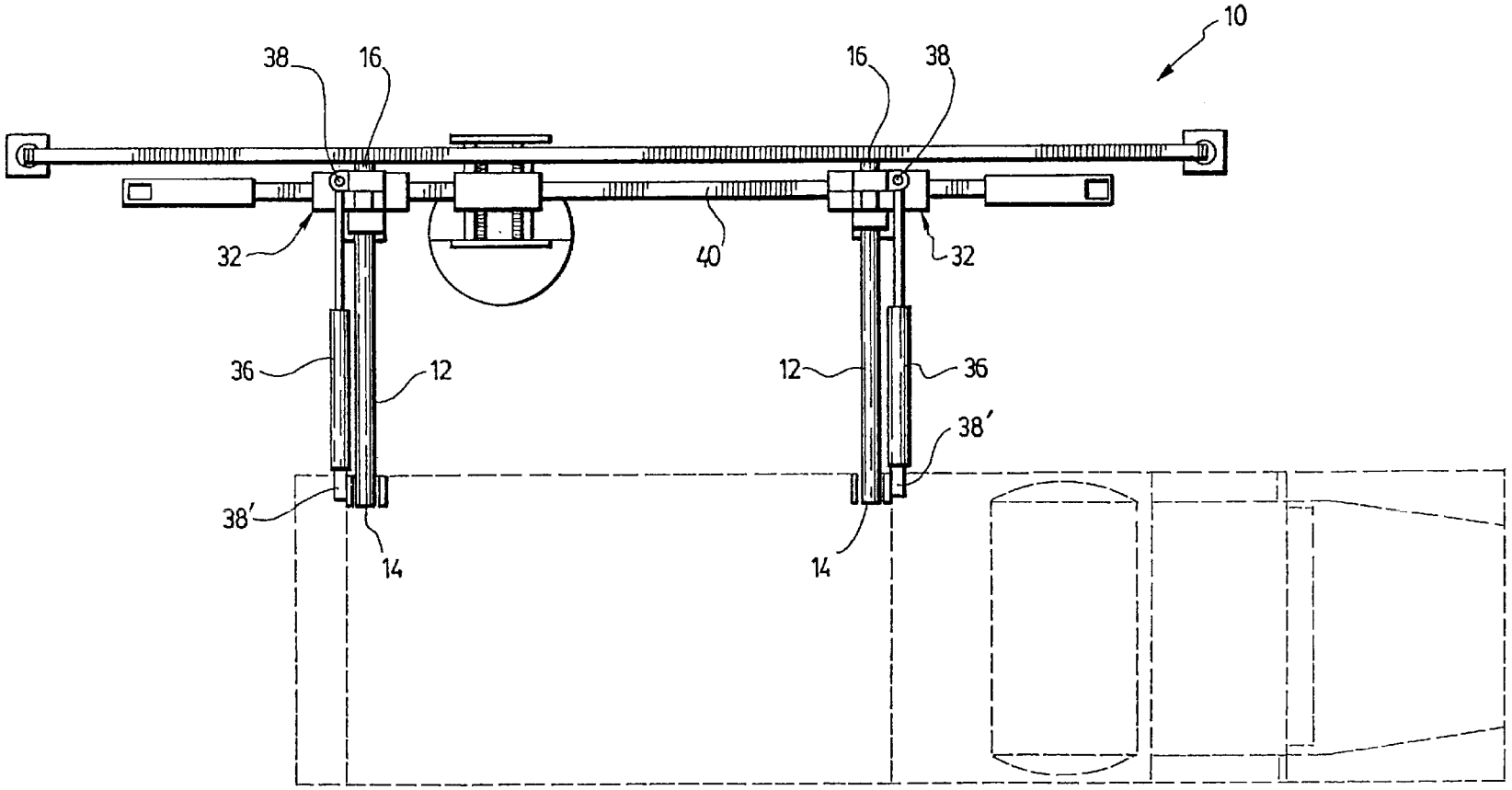
FIG. 2 is a top plan view of the machine shown in FIG. 1, with its booms in extension.
Figure 3:
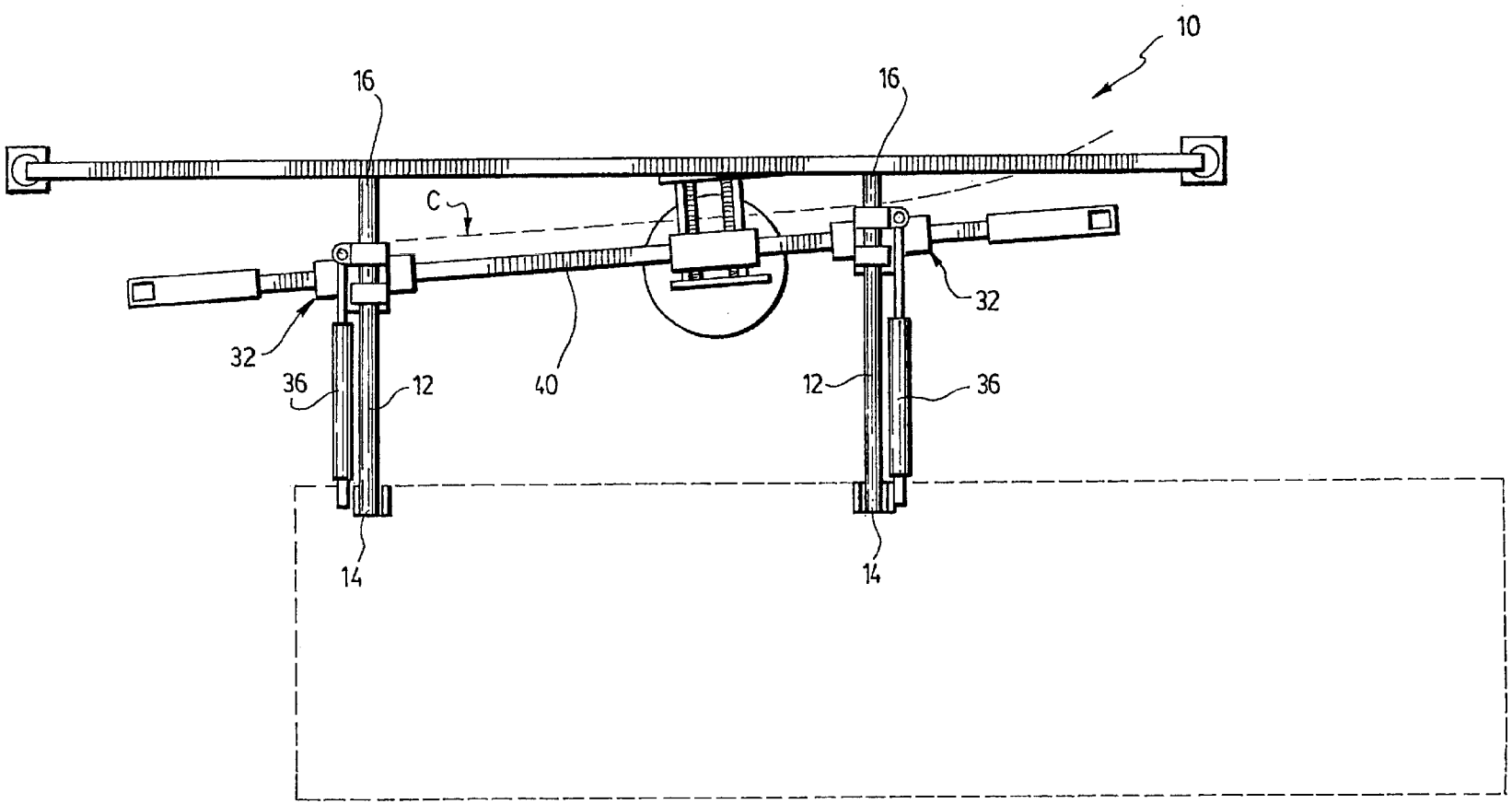
FIG. 3 is a view similar to the one of FIG. 2, showing the main rail at an angle slightly different from 90° with respect to the booms.
Figure 18:
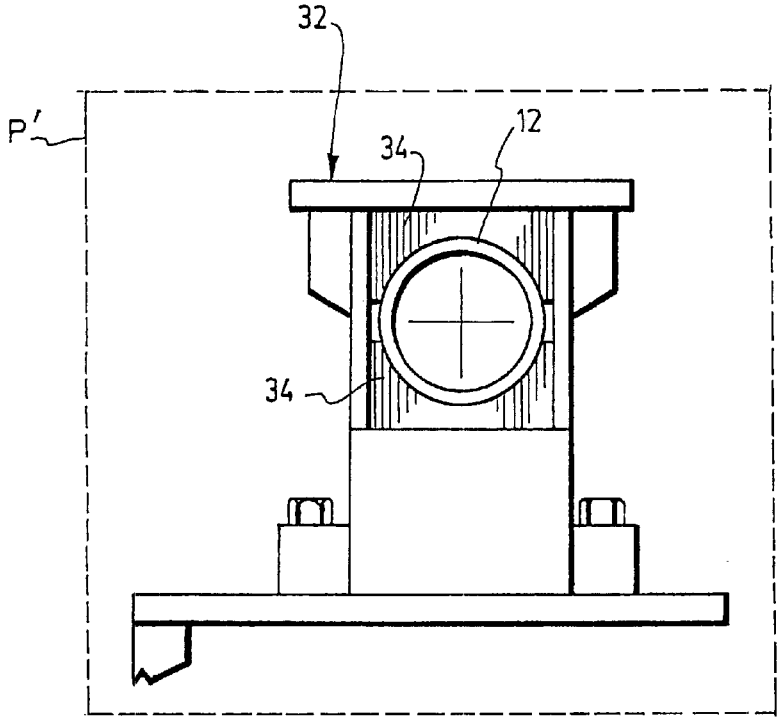
FIG. 18 is a partial cross-sectional front view of the machine according to the invention, showing how the rail-structure-holding head is mounted on the cylindrical boom.

As shown in FIGS. 2, 3 and 7, the apparatus (10) also comprises a rail-structure-holding head (32) slidably mounted on each cylindrical boom (12) so as to slide along the cylindrical boom (12) and to be free to rotate about the cylindrical boom (12) within a plane P' perpendicular to said cylindrical boom (12), as illustrated in FIG. 18. It should be understood that the plane P' is parallel to the plane P illustrated in FIG. 7.

Figure 19:
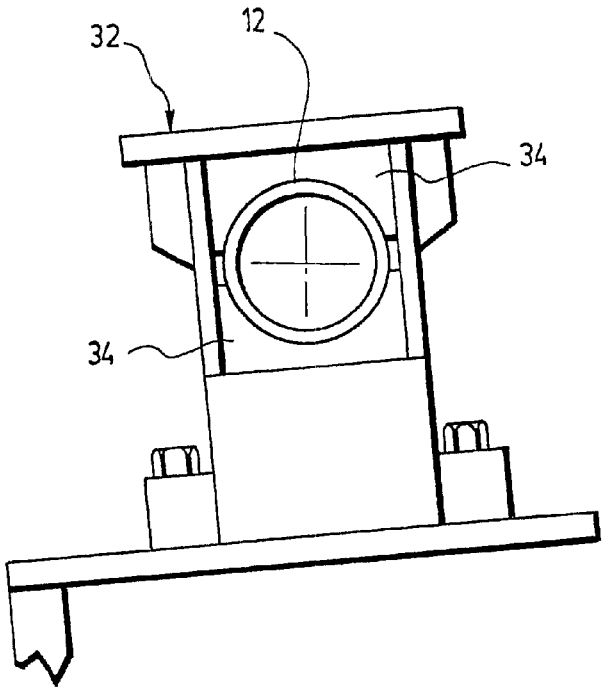
FIG. 19 is a similar view than the one of FIG. 18, where the rail-structure-holding head has rotated about the cylindrical boom within a plane perpendicular to the cylindrical boom.

In the preferred illustrated embodiment of the invention, each of the rail-structure-holding heads (32) has another surrounding means for surrounding the corresponding cylindrical boom (12) and allowing free rotation of the rail-structure-holding head (32) about the cylindrical boom (12) within the plane P'. The another surrounding means of the rail-structure-holding head (32) has the same function than the surrounding means of the supporting bar (22) but is embodied differently. More particularly, the surrounding means of the rail-structure-holding head (32) preferably comprises a pair of pads (34) as shown in FIGS. 18 and 19. Each of said pads (34) has a half-spherical groove therein in contact with the cylindrical boom (12) and is preferably made of silicone.

Referring to FIGS. 2 and 3, the apparatus (10) further comprises sliding means for sliding each head (32) separately along the corresponding boom (12). Preferably, these sliding means comprise two powered jacks (36). Each of the powered jacks (36) has its opposite ends (38, 38') respectively secured to the one end (14) of the corresponding boom (12) and to the corresponding head (32).

The apparatus (10) further comprises an elongated main rail (40) which is shown in FIGS. 1 to 11, and main rail mounting means for mounting the main rail (40) on the rail-structure-holding heads (32) and for rotating the main rail (32) about a longitudinal axis A parallel to said elongated main rail (40). The longitudinal axis A is illustrated in FIG. 7.

In the preferred illustrated embodiment of the invention, each of the rail-structure-holding heads (32) has separate connecting means for allowing connection of the main rail mounting means at different distances away from the vehicle. As shown in FIG. 7, each connecting means comprises a hole (44) made in a plate (42) that is part of each of the rail-structure-holding heads (32). Such a plate (42) is located under a portion of the cylindrical boom (12) and extends in parallel relationship with respect to the cylindrical boom (12). The plate (42) preferably includes three holes (44).

As shown in FIGS. 2 and 3, by activating distinctly each powered jack (36), the main rail (40) may adopt a diagonal position that may follow a desired cutting path C as the one illustrated in FIG. 3. Such diagonal position of the main rail (40) is possible since the main rail mounting means is designed to allow such a pivoted position of the main rail. To do so, as shown in FIG. 7, the main rail mounting means preferably comprise two spaced apart plates (48, 48') that are rigidly attached together and located on each side of the plate (42). A pivot pin (46) extends through one of the holes (44) made in the plate (42) and interconnects the plates (48, 48').

Figure 8:
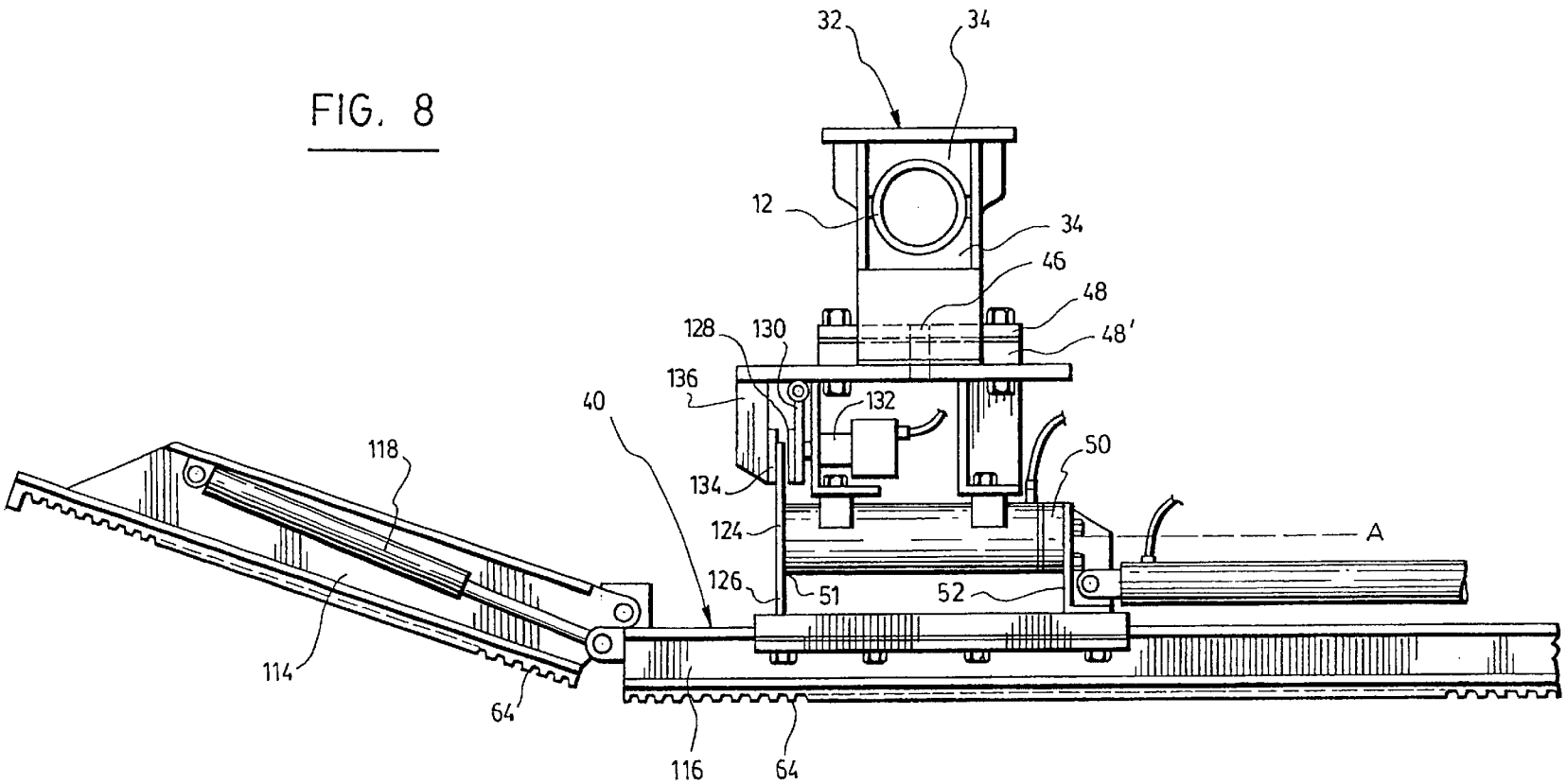
FIG. 8 is a partial view of FIG. 4, showing a distal portion of the main rail in an upward position.

As shown in FIGS. 7 and 8, the main rail mounting means of the illustrated preferred embodiment of the invention comprises a helical rotary actuator (50) attached to one of the rail-structure-holding heads (32). The helical rotary actuator (50) has a shaft (not shown) that extends along the longitudinal axis A about which the main rail (40) rotates. The main rail mounting means also comprises at least one member (52) attached to the shaft of the actuator (50) and to the main rail (40) for driving the main rail (40) into rotation about the longitudinal axis A. Preferably, the main rail mounting means comprises two helical rotary actuators (50), each of which is attached to one of the rail-structure-holding heads (32) as shown in FIGS. 4 and 5. As it can be seen in FIG. 6 where three different positions of the main rail (40) are shown (one in plain line, two others in dotted line), the rotation of the main rail (40) that is achieved by the operation of the helical rotary actuator (50), is of a wide amplitude. Such a rotation may be as wide as 220°. Such wide rotation of the main rail (40) has never been achieved before in the similar machines known in the prior art.

In the preferred illustrated embodiment of the invention, the helical rotary actuator (50) has a braking system for maintaining it in a desired rotational position. The braking system comprising a disk (124) mounted at one end (51) of the rotary actuator (50) in a perpendicular relationship with respect to the shaft (not shown) of the rotary actuator (50) as shown in FIG. 8. The disk (124) has a periphery (126) extending away from the rotary actuator (50) as illustrated in FIGS. 6 and 8. The braking system further comprises a pad (128) facing a location at the periphery (126) of the disk (124) and pressing means for pressing the pad (128) against said location at the periphery (126) of the disk (124) as shown in FIG. 8. Preferably, the pad (128) is fixed to a plate (130) which is pivotally mounted on the corresponding rail-structure-holding head (32) and extends downwardly. The pressing means preferably comprise a powered jack (132) horizontally extending behind the plate (130) in order to press the pad (128) against the disk (124) and pull it back. Pressing the pad (128) against the disk (124) maintains the rotary actuator (50) in the desired position. Removal of the pad (128) from contacting the disk (124) allows the actuator (50) to rotate on itself. In practice, it is noticeable that the helical rotary actuator (50) become slack with its lifetime and it may get hard to adjust the rotation of the actuator (50) to a precise rotational position. The use of the braking system allows fine rotational adjustment of the angle of rotation of the actuator (50) and consequently, the angle of the saw (56).

Moreover, the braking system has a slick plate of steal (134) held adjacent to the disk (124) behind the same by means of a supporting member (136) attached to the rail-structure-holding head (32) as shown in FIG. 8. The slick plate (134) is opposite to the pad (128) so that pressing the pad (128) against the disk (124) squeezes the disk (124) and stops the rotation of the rotary actuator (50). The use of the slick plate (134) prevents the disk (124) from bending.

Figure 10A:
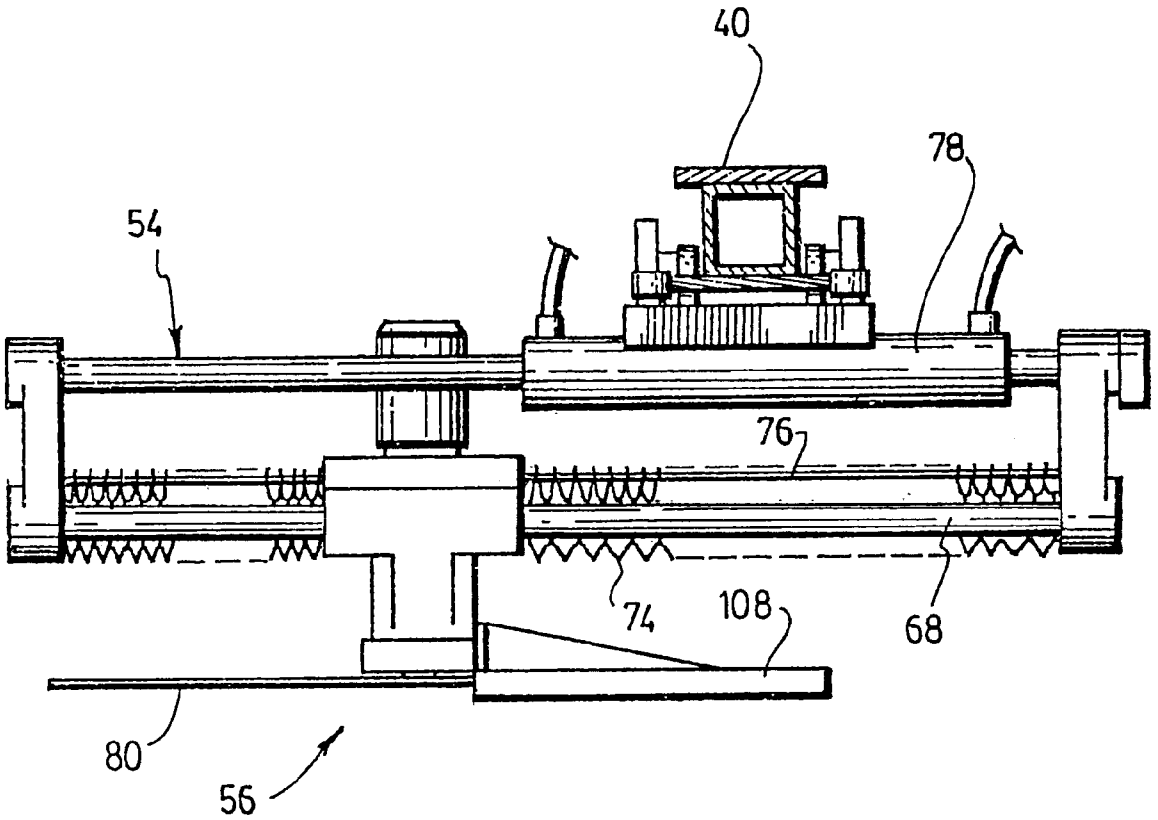
FIG. 10*a* is a side view of the saw carrier shown in FIG. 9, and the saw attached to it.
Figure 10B:
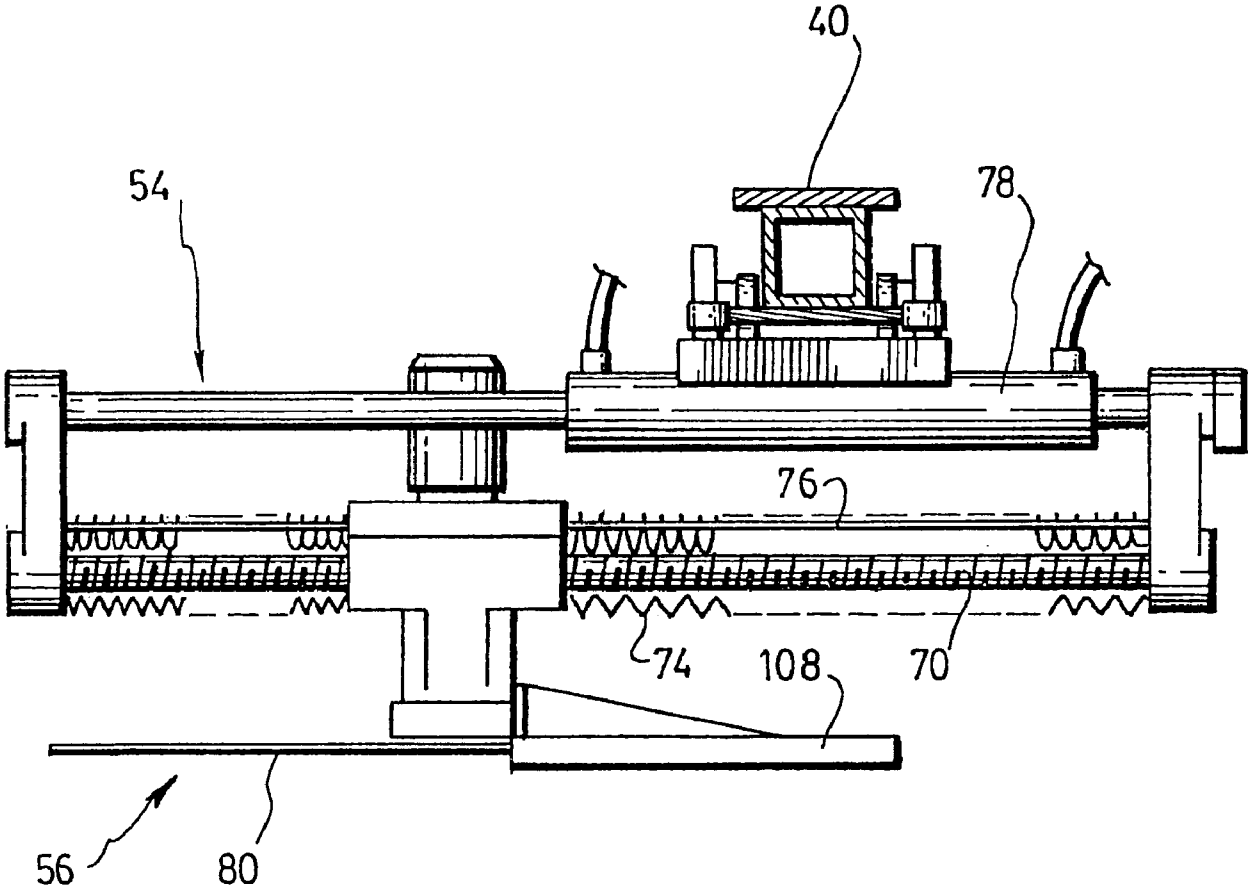
FIG. 10*b* is a cross-sectional side view taken along line Xb—Xb of FIG. 9 showing the endless screw.
Figure 11:
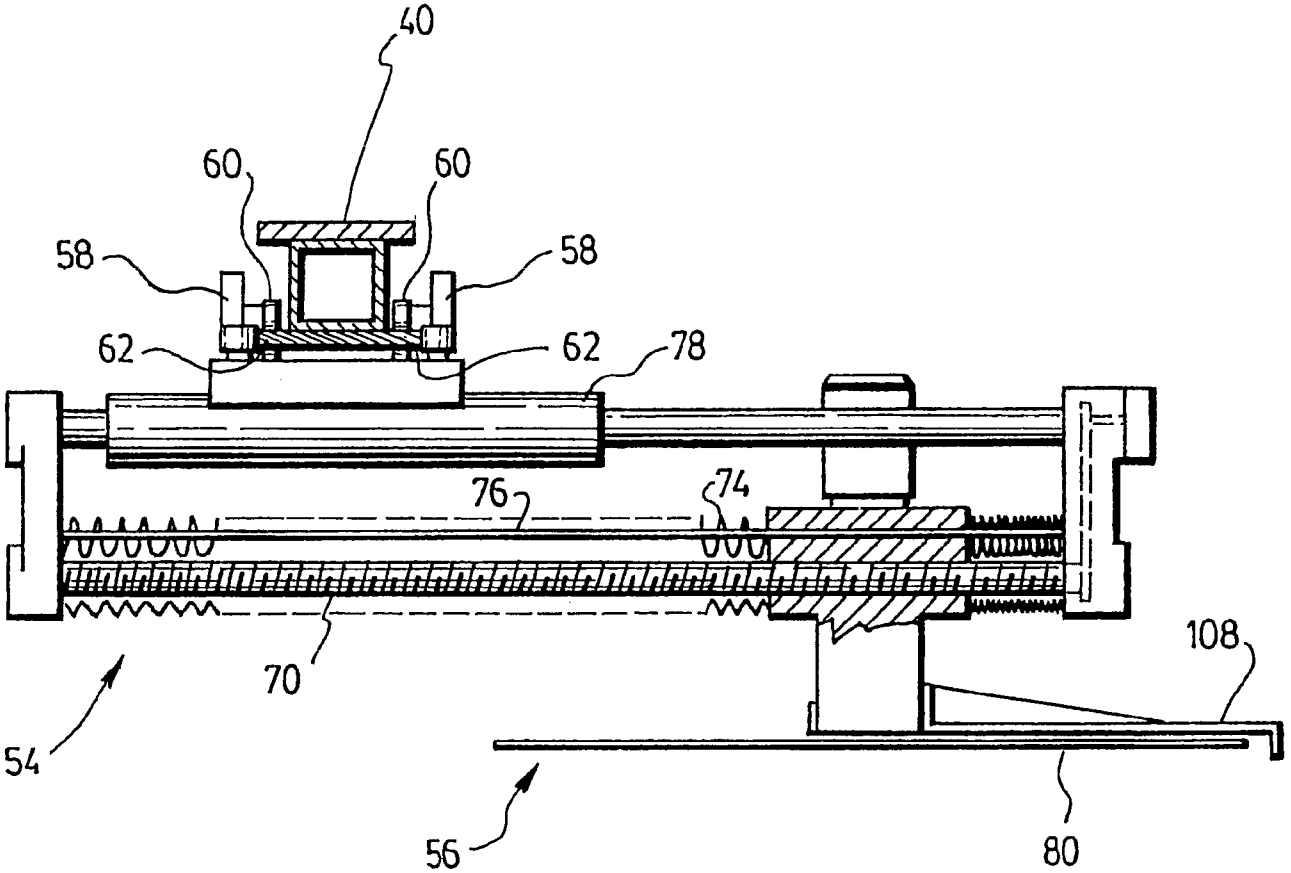
FIG. 11 is a view similar to the one of FIG. 10*b*, showing the saw carrier in a rear position with respect to the main rail and the saw in a rear position with respect to the saw carrier.
Figure 12:
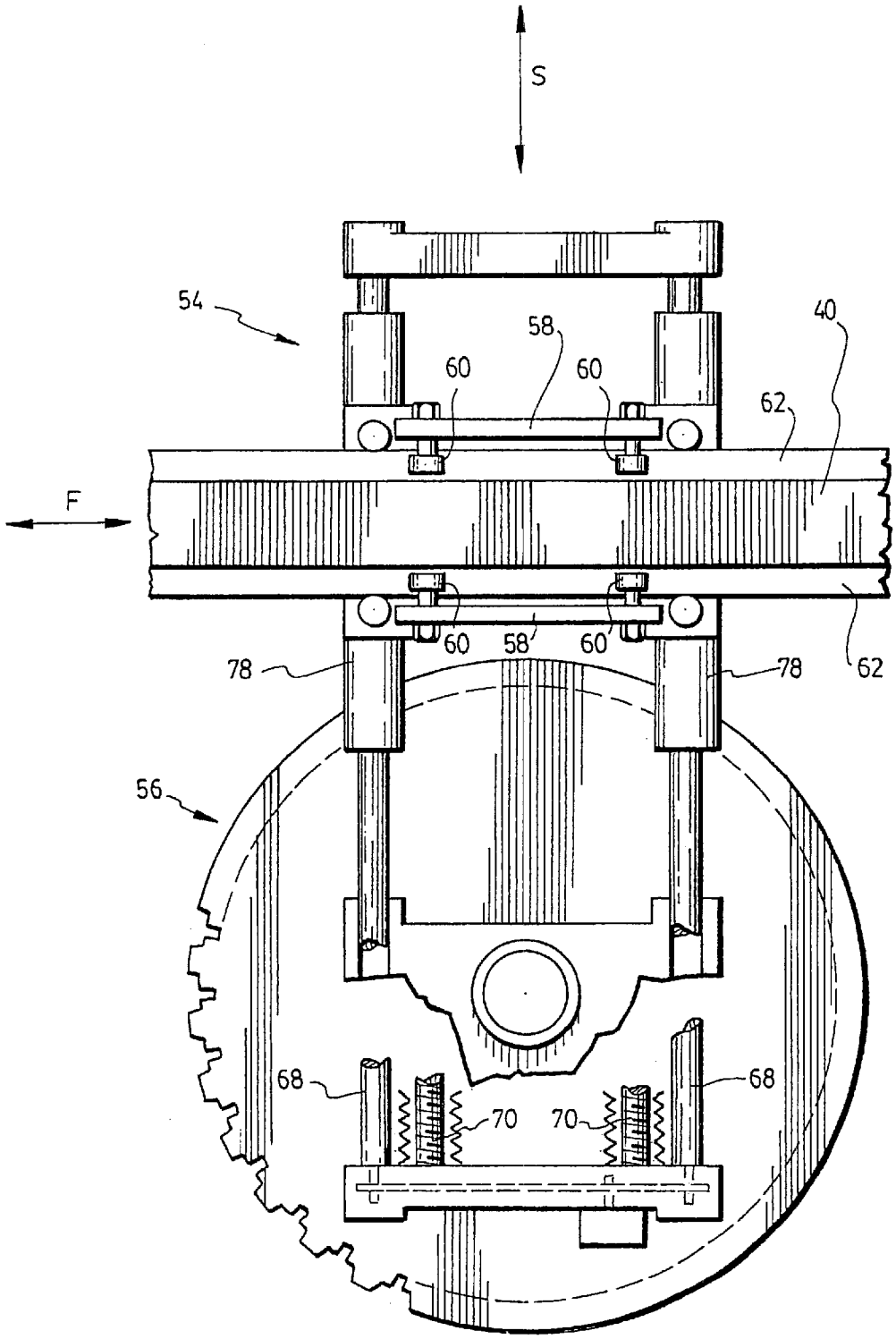
FIG. 12 is a cross-sectional top plane view of FIG. 11, showing the saw carrier mounted on the main rail, and the moving means for moving the saw on the saw carrier.

As shown in FIGS. 9, 10*a*, 10*b*, 11, 12, 13 and 14, the apparatus (10) also comprises a saw carrier (54) mounted on the main rail (40) and displacing means for moving the saw carrier (54) along the main rail (40) in a first direction F parallel to the longitudinal axis A (see FIG. 12). The apparatus (10) further comprises a motorized saw (56) mounted on the saw carrier (54) and moving means for moving the saw (56) on the saw carrier (54) in a second direction S perpendicular to said longitudinal axis A (see FIG. 12).

Figure 9:
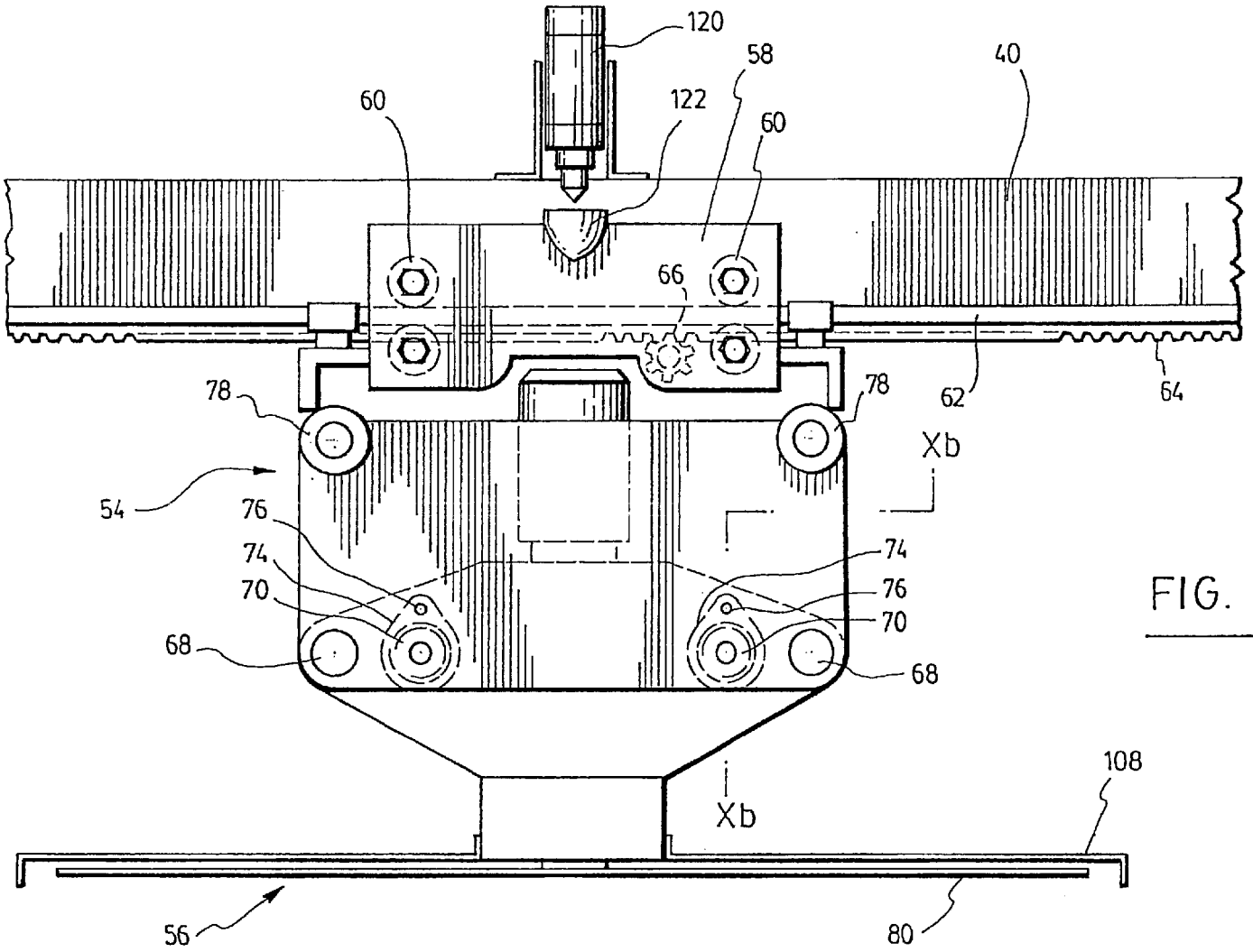
FIG. 9 is a partial view of the machine according to the invention showing the saw carrier mounted on the main rail, and the locking means for locking the saw carrier.

In the preferred illustrated embodiment of the invention, the displacing means for moving the saw carrier (54) along the main rail (40) in a first direction F comprise means for slidingly mounting the saw carrier (54) along the main rail (40). Referring more particularly to FIGS. 9 and 12, the means for slidingly mounting the saw carrier (54) preferably comprises two plates (58) vertically extending from the saw carrier (54) and positioned on each side of the main rail (40). Each plate (58) is provide with two spaced apart wheels (60) laying on a border (62) of the main rail (40) so as to be able to roll on it in the first direction F.

The displacing means for moving the saw carrier (54) along the main rail (40) in the first direction F also preferably comprise a toothed rack (64) solid with and extending all along the main rail (40), and a powered pinion wheel (66) mounted on the saw carrier (54) in such a position as to engage the toothed rack (64), as shown in FIG. 9.

Figure 16:
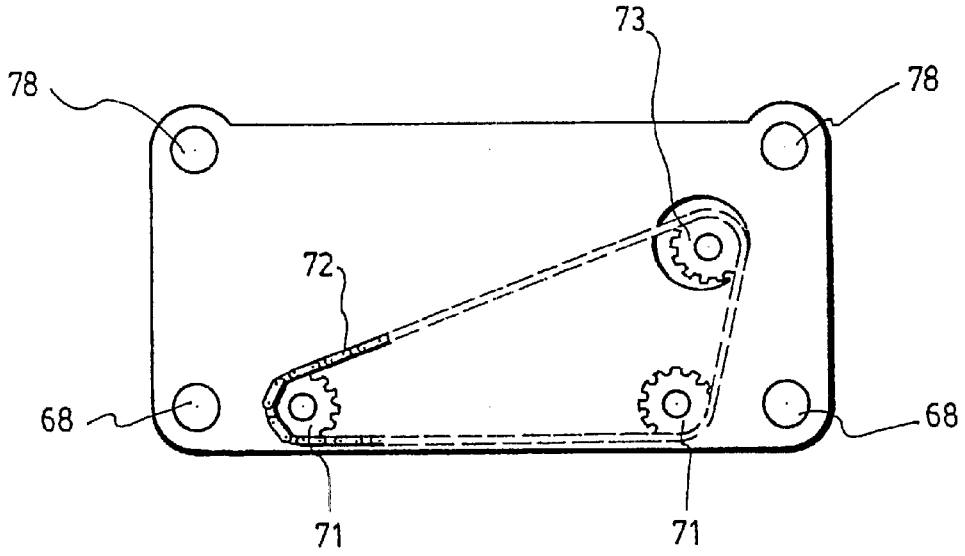
FIG. 16 is a view showing the gear driven by the powered pinion and engaging the endless screws of the saw carrier.

Referring to FIGS. 9, 10*a*, 10*b* and 11, the saw carrier (54) preferably comprises at least one pole (68) extending along the second direction S perpendicular to the longitudinal axis A. The saw (56) is slidably mounted on said at least one pole (68). The moving means for moving the saw (56) on the saw carrier (54) in the second direction S preferably comprise at least one motorized endless screw (70) that is mounted on the saw carrier (54) in parallel relationship with respect to the at least one pole (68) and is operatively engaging the saw. Preferably, the saw carrier (54) comprises two parallel pole (68) and the moving means for moving the saw (56) on the saw carrier (54) comprise two endless screws (70) as shown in FIGS. 9 and 12. As also shown in greater detail in FIG. 16, each of the endless screws (70) has a pinion (71) at one extremity. The pinions (71) of the endless screws (70) are engaged by a gear (72) that is driven by a powered pinion (73). Thus, both endless screws (70) are synchronized.

In the preferred embodiment of the invention as it is illustrated more particularly in FIGS. 9, 10*b* and 11, the moving means used for moving the saw (56) on the saw carrier (54) further comprise a flexible dust cover (74) covering each endless screw (70), and a rod (76) mounted on the saw carrier (54) in parallel relationship above each endless screw (70). The dust cover (74) is hold by the rod (76). This rod (76) prevents the dust cover (74) from contacting the endless screw (70). Preferably, the dust cover (74) is hold by the rod (76) like a curtain is hold on a pole, as shown in FIGS. 10*b* and 11. The rod (76) could also be mounted underneath the dust cover (74) and therefor preventing the dust cover (74) from contacting the endless screw (70). Each dust cover (74) prevents mud or the like to clog the corresponding endless screw (70). Each rod (76) prevents the corresponding flexible dust cover (74) from contacting the endless screw (70) and getting worn out rapidly. Indeed, replacement of the dust cover (74) is time consuming and therefore, involves expenses.

Referring to FIGS. 9, 10*a*, 10*b* and 11, the saw carrier (54) preferably comprises means for moving it in the second direction S. Such means preferably consists of at least one powered jack (78) that is securely attached to the plates (58) of the displacing means. Actuation of said jack (78) causes the saw carrier (54) to move back and forth along the second direction S as shown in FIGS. 10*a* and 10*b* (close to front position) and FIG. 11 (rear position). Advantageously, the saw carrier (54) comprise two powered jacks (78).

The fact that the saw carrier (54) may move in the second direction S with respect to the main rail (40) and the saw (56) may also move in the second direction S with respect to the saw carrier (54) increases the length of displacement of the saw (54) towards or away from the vehicle (2). Therefore, the saw (56) may advantageously cut close to the vehicle (2) or far away from it and even beyond the legs (28) of the supporting bar (22). This increase in the length of displacement of the saw (56) along the second direction S is even further increased by the fact that the main rail (40) may be mounted at several distinct positions on the rail-structure-holding heads (32) by means of the connecting means (44) as was explained above. All these adjustments of the position of the saw (56) allows for example, the legs (28) of the supporting bar (22) to lean solidly on the side of a bridge and thus to allow cutting beyond the legs (28) at the extreme edge of the bridge. When the main rail (40) is mounted on the rail-structure-holding heads (32) at the closest position from the vehicle (2), the apparatus (10) may not extend beyond the supporting bar and the whole machine occupies only two road lines instead of three road lines. This is advantageous for limiting traffic jams.

Figure 15:
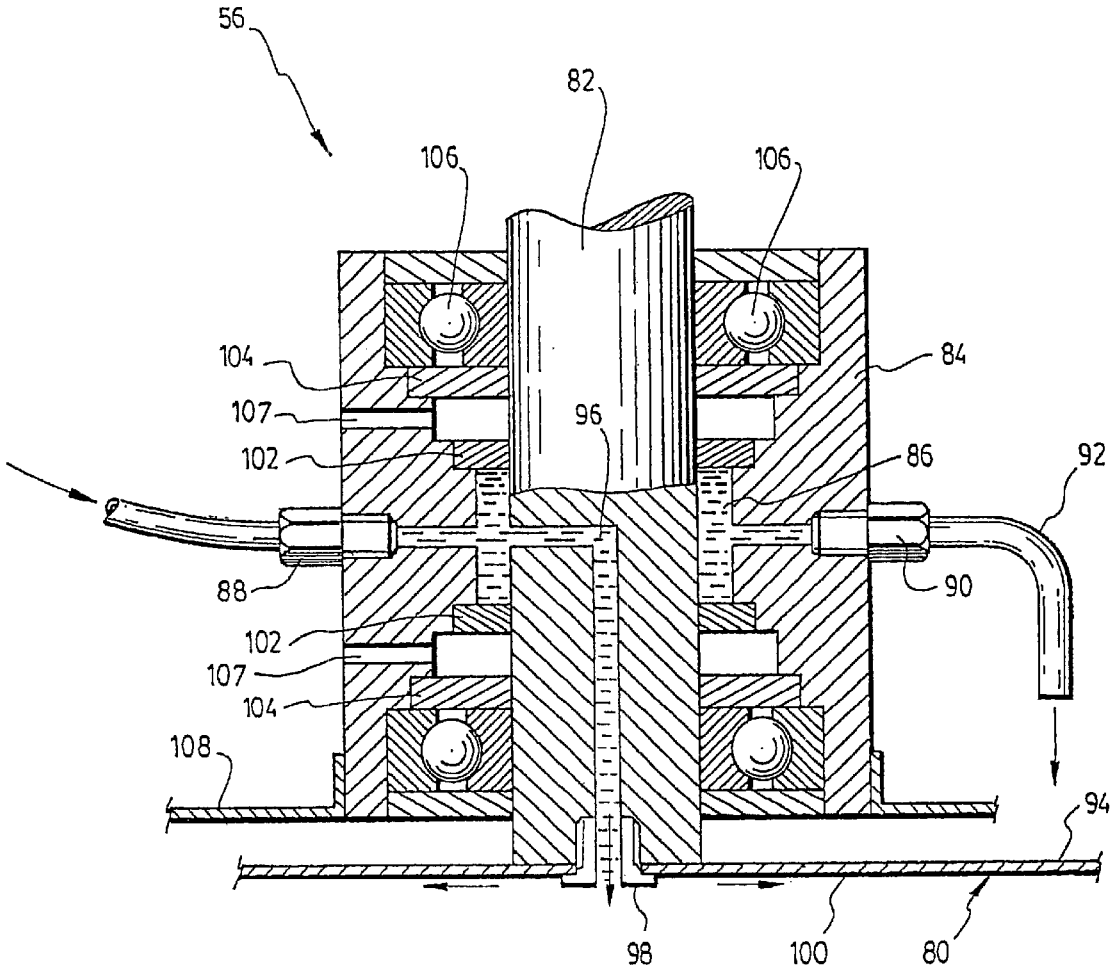
FIG. 15 is a cross-sectional side elevational view of part of the saw of the machine according to the invention, showing the rotary blade, the motorized propeller shaft for propelling the rotary blade, the holding structure surrounding the propeller shaft, and the cooling system

In the preferred illustrated embodiment of the invention as it is more particularly shown in FIG. 15, the saw (56) has a rotary blade (80), a motorized propeller shaft (82) for propelling the rotary blade (80), a holding structure (84) surrounding the propeller shaft (82), and a cooling system. The cooling system comprises a ring-shaped recess (86) made into the holding structure (84). The ring-shaped recess (86) surrounds the propeller shaft (82) and is in contact with it. The cooling system also comprises a water inlet (88) in the ring-shaped recess (86), and a water outlet (90) in the ring-shaped recess (86). The water outlet (90) has an exhaust (92) directed towards the top surface (94) of the rotary blade (80). The cooling system further comprises an L-shaped water duct (96) made into the propeller shaft (82). The L-shaped water duct (96) opens into the ring-shaped recess (86) and exits at the bottom (98) of the propeller shaft (82) so as to bring water to a bottom surface (100) of the rotary blade (80).

Due to the rotation of the propeller shaft (82), the water provided in the ring-shaped recess (86) by the water inlet (88) is distributed in the L-shaped water duct (96) and the water outlet (90) so as to reach the top surface (94) and the bottom surface (100) of the rotary blade (80). The water that comes out from the bottom (98) of the propeller shaft (82), is spread out on the whole bottom surface (100) of the rotary blade (80) by the centrifugal force generated by the rotation of the propeller shaft (82). Thus, water is spread on both top and bottom surfaces (94, 100) of the rotary blade (80) to cool it.

Referring to FIG. 15, the ring-shaped recess (86) is preferably sealed by two pairs of O-ring s (102, 104). If one of the O-ring s (102) of the first pair breaks, the O-ring s (104) of the second pair will prevent the water from getting into contact with the bearings (106) of the propeller shaft (82). For this purpose, two water drains (107) are provided to allow the water to leak out. This leak of water is the sign that an O-ring (102) is broken and its replacement has to be done.

Figure 17:
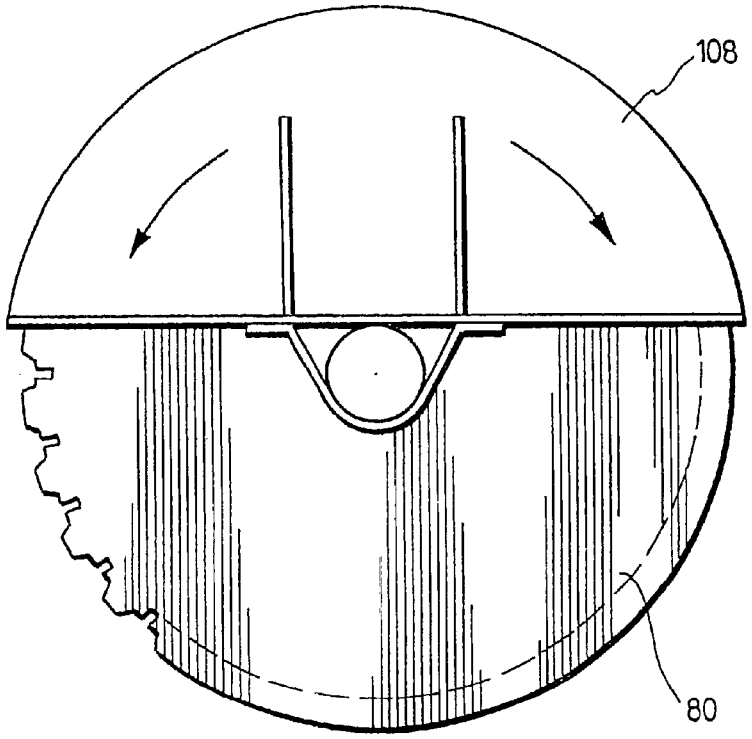
FIG. 17 is a partial top view of the saw of the machine of the invention, showing the rotary blade and its articulated guard.

In the illustrated preferred embodiment of the invention, the saw (56) further comprises an articulated guard (108) that substantially covers half of the rotary blade (80) as shown in FIG. 17. The guard (108) is pivotally mounted on the saw (56) so as to uncover any portion of the periphery of the rotary blade (80). The arrows in FIG. 17 indicate the possible rotations of the articulated guard (108). The use of such an articulated guard (108) is very convenient and allows cutting in any desired orientation.

In the illustrated preferred embodiment, the main rail (40) may also move in the first direction F parallel to the longitudinal axis A. Movement of the main rail (40) is shown in FIGS. 4 and 5. For this purpose, the main rail mounting means preferably comprises sliding means for sliding the main rail in the first direction F parallel to the longitudinal axis A, and a powered jack (110) having opposite ends (112) respectively connected to the main rail mounting means and the main rail (40). The end (112) of the powered jack (110) that is connected to the main rail mounting means, may be connected to any part thereof but it is preferably connected to the member (52) attached to the shaft of one of the helical rotary actuators (50).

Figure 13:
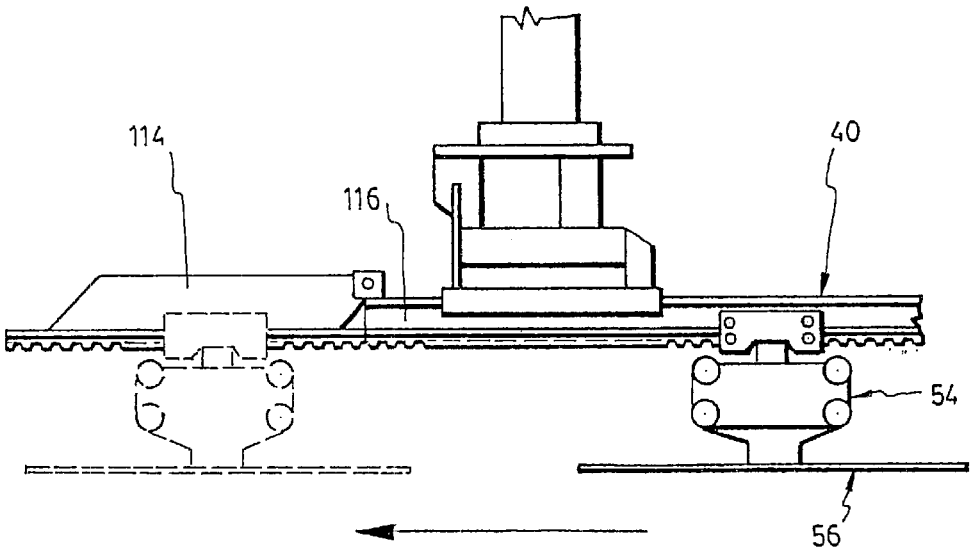
FIG. 13 is a partial view of FIG. 4, showing the saw carrier on a central portion of the main rail and on a distal portion of the main rail.
Figure 14:
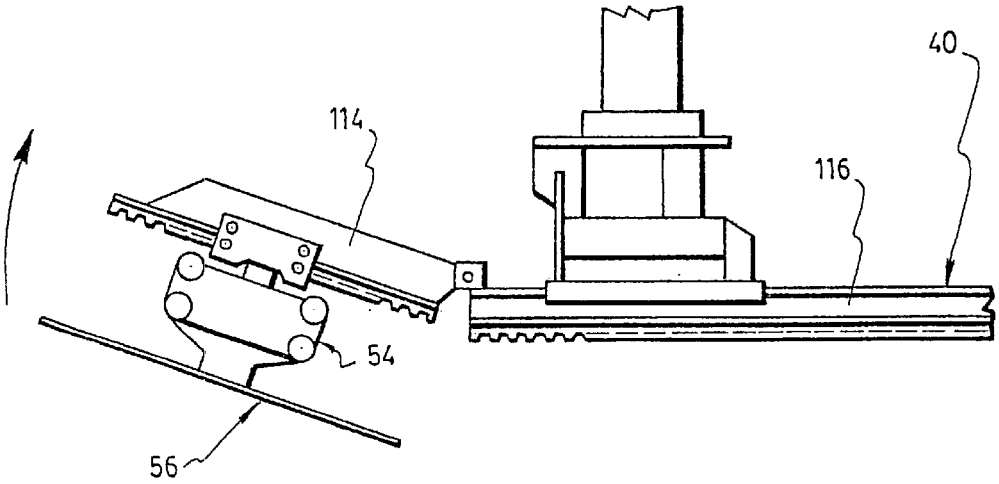
FIG. 14 is a view similar to the one of FIG. 13, showing the saw carrier on a distal portion of the main rail, where said distal portion is in an upward position.

Referring to FIGS. 8, 13 and 14, the main rail (40) preferably comprises at least one and preferably two distal portions (114) pivotally connected to its central portion (116) and a powered jack (118) secured respectively to each of the distal portions (114) and the central portion (116) of the main rail (40) for upwardly pivoting the distal portion (114). The toothed rack (64) extends along the distal portion (114) so that the saw carrier (54) may be displaced under the distal portion (114) of the main rail (40) as shown in FIG. 13 before pivoting upwardly the distal portion (114) as shown in FIG. 14. In such a position, the saw (56) may cut along a diagonal line having a high degree of inclination.

As shown in FIG. 9, the apparatus preferably further comprises locking means for locking the saw carrier (54) when the powered truck-like vehicle (2) shown in FIG. 1 is moving, so as to prevent any sliding motion of the saw carrier (54) along the main rail (40). The locking means preferably comprise a joining pin (120) secured to the main rail (40) and a joining pin receiver (122) secured to one of the plates (58) of the displacing means of the saw carrier (54).

As shown in FIG. 1, the support base (4) of the machine (1) preferably comprises extendible, ground-contacting legs (124) for stabilizing the apparatus (10) whenever required.

Although a preferred embodiment of the invention has been described in detail herein and illustrated in the accompanying drawings, it is to be understood that the invention is not limited to the precise embodiment and that various changes and modifications may be effected therein without departing from the scope or the spirit of the invention.

What is claimed is:

1. A machine including a powered truck-like vehicle having a support base and an apparatus mounted on the base for cutting pavement, said apparatus comprising:

two spaced-apart cylindrical booms, each boom having one end pivotally mounted on the base and an opposite end;

tilting means mounted on said base for tilting each boom about its one end in a vertical plane;

a supporting bar mounted on the opposite ends of the cylindrical booms so as to be free to rotate about the cylindrical booms within a plane perpendicular to the cylindrical booms;

an extendible, ground-contacting leg at each end of the supporting bar for stabilizing the apparatus;

a rail-structure-holding head slidably mounted on each cylindrical boom so as to slide along the cylindrical boom and to be free to rotate about the cylindrical boom within a plane perpendicular to said cylindrical boom;

sliding means for sliding separately each head along the corresponding boom;

an elongated main rail;

main rail mounting means for mounting the main rail on said heads and for rotating the main rail about a longitudinal axis parallel to said elongated main rail;

a saw carrier mounted on the main rail;

displacing means for moving the saw carrier along the main rail in a first direction parallel to the longitudinal axis;

a motorized saw mounted on the saw carrier; and moving means for moving the saw on the saw carrier in a second direction perpendicular to said longitudinal axis.

2. The machine of claim 1, wherein the supporting bar has a surrounding means for surrounding each opposite end of the cylindrical booms and allowing said free rotation of the supporting bar about the cylindrical booms.

3. The machine of claim 2, wherein each surrounding means comprises a ring solidly attached under the supporting bar.

4. The machine of claim 1, wherein each of the rail-structure-holding heads has another surrounding means for surrounding the corresponding cylindrical boom and allowing said free rotation of the rail-structure-holding head about the cylindrical boom.

5. The machine of claim 4, wherein the surrounding means of the rail-structure-holding head comprises a pair of pads, each of said pads having a half-spherical groove therein in contact with the cylindrical boom and being made of silicone.

6. The machine of claim 1, wherein each of the rail-structure-holding heads has separate connecting means for allowing connection of the main rail mounting means at different distances away from the vehicle.

7. The machine of claim 6, wherein the rail-structure-holding heads has three separate connecting means.

8. The machine of claim 6, wherein each of the rail-structure-holding heads comprises a plate located under a portion of the cylindrical boom and extending in parallel with said cylindrical boom, and each connecting means comprises an hole made in the plate for removably attaching the main rail mounting means.

9. The machine of claim 6, wherein the main rail mounting means comprises:

an helical rotary actuator attached to one of the rail-structure-holding heads, the helical rotary actuator having a shaft extending along the longitudinal axis about which the main rail rotates; and at least one member interconnecting said shaft and the main rail for driving the main rail into rotation about the longitudinal axis.

10. The machine of claim 9, wherein the saw has a rotary blade, a motorized propeller shaft for propelling the rotary blade, a holding structure surrounding the propeller shaft, and a cooling system, the cooling system comprises:

a ring-shaped recess made into the holding structure, the ring-shaped recess surrounding the propeller shaft and being in contact with it;

a water inlet in the ring-shaped recess;

a water outlet in the ring-shaped recess, the water outlet having an exhaust directed towards a top surface of the rotary blade;

an L-shaped water duct made into the propeller shaft, the L-shaped water duct opening into the ring-shaped recess and exiting at a bottom of the propeller shaft so as to conduct water to a bottom surface of the rotary blade.

11. The machine of claim 10, wherein the saw has a rotary blade and an articulated guard substantially covering half of the rotary blade, said guard being pivotally mounted on the saw so as to uncover any portion of the periphery of the rotary blade.

12. The machine of claim 1, wherein the main rail mounting means comprises:

an helical rotary actuator attached to one of the rail-structure-holding heads, the helical rotary actuator having a shaft extending along the longitudinal axis about which the main rail rotates; and at least one member attached to said shaft and to the main rail for driving the main rail into rotation about the longitudinal axis.

13. The machine of claim 12, wherein the main rail mounting means comprises two of said helical rotary actuator, each of said helical rotary actuators being attached to one of said rail-structure-holding heads.

14. The machine of claim 12, wherein said helical rotary actuator has a braking system for maintaining the rotary actuator in a desired rotational position;

the braking system comprising:

a disk mounted at one end of the rotary actuator in perpendicular relationship with respect to the shaft of the rotary actuator, the disk having a periphery extending away from the rotary actuator;

a pad facing a location at the periphery of the disk; and pressing means for pressing the pad against said location at the periphery of the disk.

15. The machine of claim 12, wherein the at least one member comprises sliding means for sliding the main rail in the first direction parallel to the longitudinal axis of the main rail; and wherein the main rail mounting means comprises a powered jack having ends respectively connected to the at least one member and the main rail.

16. The machine of claim 1, wherein the main rail mounting means comprises:

sliding means for sliding the main rail in the first direction parallel to the longitudinal axis of the main rail; and a powered jack having ends respectively connected to the main rail mounting means and the main rail.

17. The machine of claim 1, wherein the sliding means for sliding separately each rail-structure-holding head along the corresponding boom comprise two powered jacks, each of said powered jacks having ends secured respectively to the one end of the corresponding boom and the corresponding head.

18. The machine of claim 1, wherein the displacing means for moving the saw carrier along the main rail in a first direction parallel to the longitudinal axis comprise:

means for slidingly mounting the saw carrier along the main rail;

a toothed rack solid with and extending all along the main rail; and a powered pinion wheel mounted on the saw carrier and adapted to engaged the toothed rack.

19. The machine of claim 1, wherein the main rail comprises a distal portion thereof being pivotally connected to a central portion of the main rail and a powered jack secured respectively to the distal portion and the central portion of the main rail for upwardly pivoting the distal portion.

20. The machine of claim 1, wherein the saw carrier comprises at least one pole extending along the second direction perpendicular to the longitudinal axis, the saw being slidably mounted on said at least one pole; and wherein the moving means for moving the saw on the saw carrier in the second direction comprise at least one motorized endless screw mounted on the saw carrier in parallel relationship with respect to the at least one pole and operatively engaging the saw.

21. The machine of claim 20, wherein the moving means for moving the saw on the saw carrier further comprise:

a flexible dust cover covering the endless screw; and a rod mounted on the saw carrier in parallel relationship above the endless screw, said rod preventing the dust cover from contacting the endless screw.

22. The machine of claim 1, wherein the saw has a rotary blade, a motorized propeller shaft for propelling the rotary blade, a holding structure surrounding the propeller shaft, and a cooling system, the cooling system comprises:

a ring-shaped recess made into the holding structure, the ring-shaped recess surrounding the propeller shaft and being in contact with it;

a water inlet in the ring-shaped recess;

a water outlet in the ring-shaped recess, the water outlet having an exhaust directed towards a top surface of the rotary blade;

an L-shaped water duct made into the propeller shaft, the L-shaped water duct opening into the ring-shaped recess and exiting at a bottom of the propeller shaft so as to bring water to a bottom surface of the rotary blade.

23. The machine of claim 1, wherein the saw has a rotary blade and an articulated guard substantially covering half of the rotary blade, said guard being pivotally mounted on the saw so as to uncover any portion of the periphery of the rotary blade.

24. The machine of claim 1, wherein the apparatus further comprises locking means for locking the saw carrier when the powered truck-like vehicle is moving so as to prevent any sliding motion of the saw carrier along the main rail.

25. The machine of claim 1, wherein the support base comprises extendible, ground-contacting legs for stabilizing the apparatus whenever required.

* * * * *